US006164822A

United States Patent [19]

Beer

[11] Patent Number: 6,164,822

[45] Date of Patent: Dec. 26, 2000

[54] DUAL COMPARTMENT STAND-UP POUCH

[75] Inventor: Jeffrey Scott Beer, Perkiomenville, Pa.

[73] Assignee: Fres-co System USA, Inc., Telford, Pa.

[21] Appl. No.: 09/501,855

[22] Filed: Feb. 10, 2000

[51] Int. Cl.[7] ..... B65D 30/22

[52] U.S. Cl. ..... 383/38; 383/80; 383/104; 383/906; 222/94; 222/145.1

[58] Field of Search ..... 383/38, 80, 104, 383/906; 222/94, 145.1

[56] References Cited

U.S. PATENT DOCUMENTS

| | | | |
|---|---|---|---|
| 3,980,222 | 9/1976 | Hood | 383/38 X |
| 4,256,256 | 3/1981 | Meyers . | |
| 4,732,299 | 3/1988 | Hoyt | 383/906 X |
| 4,795,271 | 1/1989 | Lane, Jr. et al. | 383/38 X |
| 4,805,767 | 2/1989 | Newman . | |
| 4,886,373 | 12/1989 | Corella . | |
| 5,114,044 | 5/1992 | Spanek, Jr. et al. | 383/906 X |
| 5,265,961 | 11/1993 | Boyd | 383/38 X |
| 5,350,240 | 9/1994 | Billman et al. . | |
| 5,353,927 | 10/1994 | Stupar et al. . | |
| 5,407,278 | 4/1995 | Beer . | |
| 5,714,023 | 2/1998 | Redfern | 222/145.1 X |
| 5,860,743 | 1/1999 | Larkin et al. . | |
| 5,882,120 | 3/1999 | Bell . | |
| 5,921,440 | 7/1999 | Maines | 222/94 X |

FOREIGN PATENT DOCUMENTS

| | | | |
|---|---|---|---|
| 2351870 | 2/1977 | France | 383/38 |

*Primary Examiner*—Jes F. Pascua
*Attorney, Agent, or Firm*—Caesar, Rivise, Bernstein, Cohen & Pokotilow, Ltd.

[57] ABSTRACT

A dispensing package formed of a flexible material, e.g., a plastic film or laminate, and having two separate compartments for holding paste-like materials therein until they are to be dispensed together from the package. The package also includes an outlet in the form of a fitment having a removable cap coupled to the two compartments. The first compartment is formed by an outer panel of the package and one section of a gusset panel which forms a first inner panel. The second compartment is formed by another outer panel of the package an another section of the gusset panel which forms a second inner panel. One outer panel and its immediately adjacent inner panel are secured together along their bottom marginal edges. The other outer panel and its immediately adjacent outer panel are welded together along their bottom marginal edges. All of the panels are also welded together along their side marginal edges to form the two compartments, with each compartment having a passageway at the top thereof in communication with the fitment. The fitment is coupled to the passageways of the compartments to enable the contents of the two compartments to be ejected, e.g., squeezed, out the fitment from the package together. The two compartments are juxtaposed with respect to each other, with the inner panels being disposed in a confronting relationship with each other but arranged to be spaced apart from each other, whereupon the bottom edge of the two compartment form a wide, stable base for supporting the package in an upright orientation.

9 Claims, 4 Drawing Sheets

4
62
34
26
3
24
22
3
38
30
28
12
40
36
4

FIG. 2
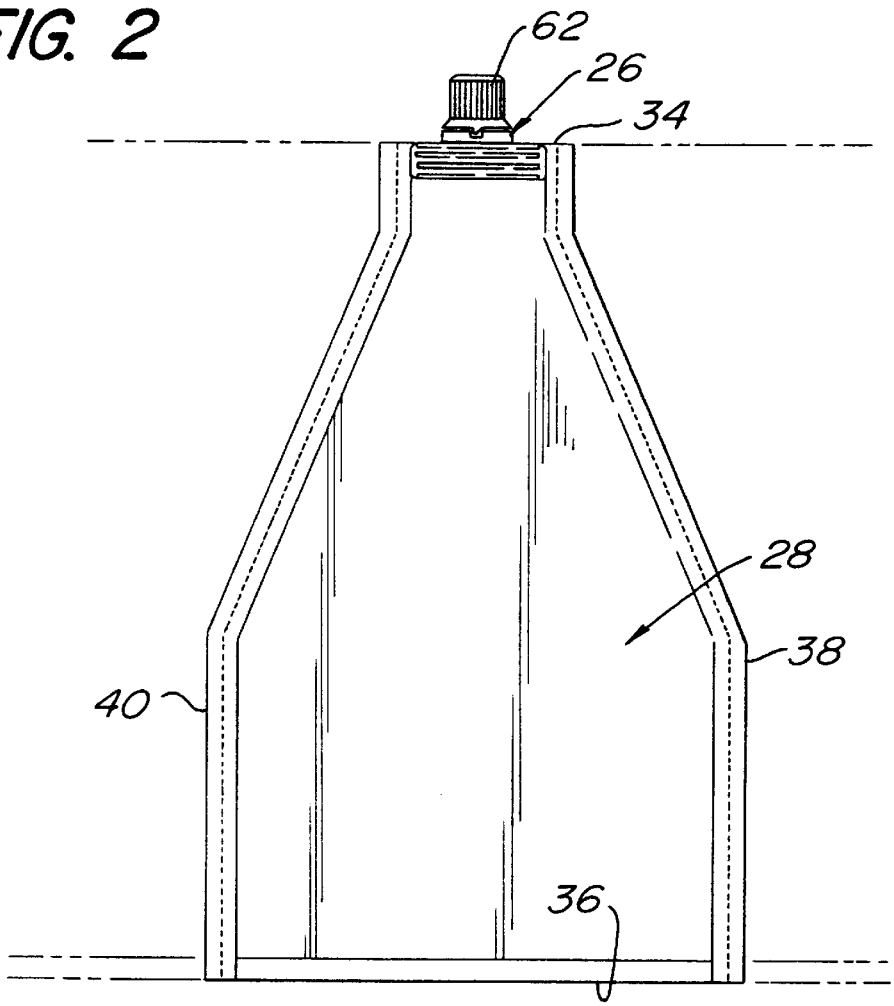
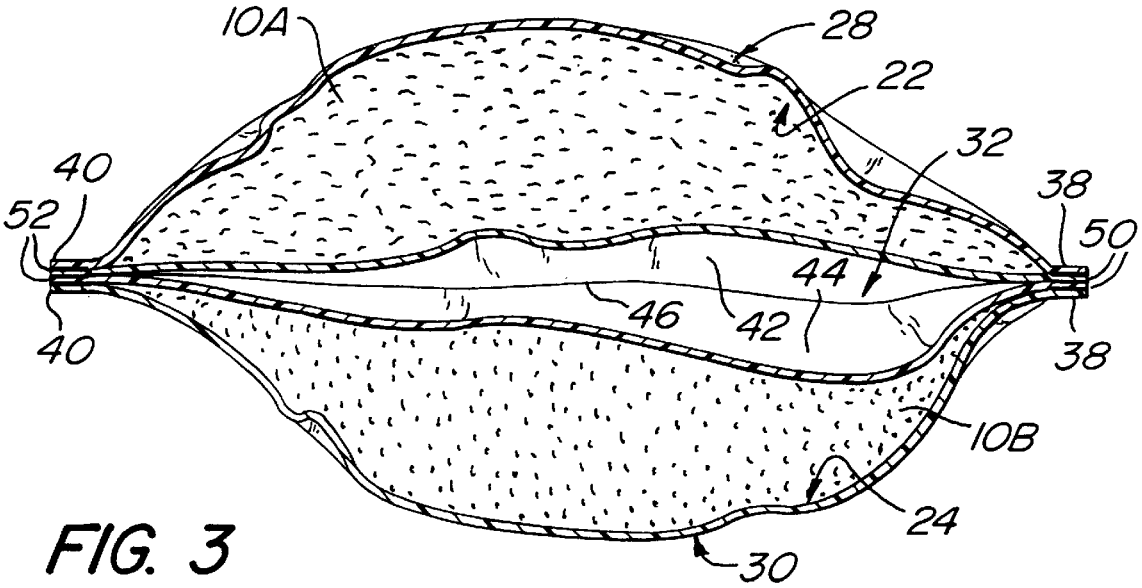
FIG. 3

DUAL COMPARTMENT STAND-UP POUCH

BACKGROUND OF THE INVENTION

This invention relates generally to flexible packaging and more particularly to flexible packages for holding two paste-like or flowable materials in separate compartments for enabling the simultaneous dispensing of such materials from the package.

Flexible containers formed of sheet materials have gained wide acceptance in the trade for holding food products or other air-perishable materials therein. One common type of flexible package container is the so-called "stand-up" package. That package is arranged to be filled and sealed to isolate the contents of the package from the ambient atmosphere. Typically such packages are formed from a web of flexible stock material, e.g., polyethylene, polyester, polypropylene, metal foil, and combinations thereof in single or multiple plies.

The following United States patents disclose various types of flexible stand-up packaging: U.S. Pat. No. 4,886,373 (Corella), U.S. Pat. No. 5,882,120 (Bell), U.S. Pat. No. 5,350,240 (Billman et al.), and U.S. Pat. No. 5,860,743 (Larkin et al.). While the stand-up packages of these patents are generally suitable for their intended purposes, none is suitable for holding two flowable materials separately until joint dispensing of them is desired.

In my U.S. Pat. No. 5,407,278 (Beer) there is disclosed a flexible package having a hollow interior including a pair of compartments for holding respective granular or powdered products isolated from each other. The package is formed of flexible sheet material and in one embodiment comprises a front panel, a rear panel, and an intermediate panel. The front and rear panels each have a top edge portion, a bottom edge portion, and a pair of sides which are connected together. The bottom edge portions of the front and rear panels are sealed together. The intermediate panel has a pair of side edges and a bottom edge portion, with one of the side edges sealed to the package along one of the sides, and the other of the side edges is peelably sealed to the rear panel in one embodiment and to the front panel in another embodiment. The top edge portion of the intermediate panel is permanently sealed to the top edge portion of one panel and is peelably sealed to the top edge portion of the other panel. The bottom edge portion of the intermediate panel is permanently sealed to the front and rear panels. The space between the intermediate panel and the panel to which is peelably secured forms one compartment and the space between the intermediate panel and the other panel forms the other compartment. A hand peelable seal extends across the top portion of the panels to releasably seal the materials within the compartments and to enable the package to be readily peeled open to simultaneously pour the contents of the compartments therefrom.

Other prior art United States patents disclose flexible packages for holding two or more flowable materials in separate compartments, such as: U.S. Pat. No. 4,256,256 (Meyers), U.S. Pat. No. 4,805,767 (Newman), and U.S. Pat. No. 5,353,927 (Stupar).

While the plural-compartment packages of the aforementioned patents are generally suitable for their intended purposes, none is suitable for holding two flowable materials separately in a very stable, stand-up configuration.

OBJECTS OF THE INVENTION

Accordingly, it is a general object of this invention to provide a flexible package which overcomes the disadvantages of the prior art.

It is a further object of this invention to provide a dispensing pouch which is arranged to hold two paste-like or other flowable materials in respective compartments until they are to be dispensed together from the package.

It is a further object of this invention to provide a dispensing pouch which is simple in construction and arranged to hold two paste-like or other flowable materials in respective compartments in a manner so that the package can support itself in an upright orientation on any horizontal surface.

SUMMARY OF THE INVENTION

These and other objects of this invention are achieved by providing a dispensing package formed of a flexible material, e.g., a plastic film or laminate, and comprising first and second separate compartments and an outlet, e.g., a dispenser in the form of a fitment having a removable cap, coupled to the two compartments. The first compartment has a first outer panel and a first inner panel. The second compartment has a second outer panel and a second inner panel.

The first outer panel and the first inner panel of the first compartment each have a top portion, a pair of side marginal edges and a bottom edge. The bottom edge of the first outer panel and the first inner panel are secured, e.g., heat sealed or welded, together. The top portion of the first outer panel and the top portion of said first inner panel define a first passageway between them. The second outer panel and the second inner panel of the second compartment each have a top portion, a pair of side marginal edges and a bottom edge. The bottom edge of the second outer panel and the second inner panel are secured, e.g., heat sealed or welded, together. The top portion of the second outer panel and the top portion of the second inner panel define a second passageway between them. The side marginal edges of the first outer panel, the first inner panel, the second outer panel and the second inner panel are all secured, e.g., heat sealed or welded, together.

The two compartments are juxtaposed with respect to each other, with the first and second inner panels being disposed in a confronting relationship with each other. The first and second inner panels are arranged to be spaced apart from each other, whereupon the bottom edge of the first compartment and the bottom edge of the second compartment form a wide, stable base for supporting the package in an upright orientation.

The dispenser, e.g., the fitment with the cap, is coupled to the two passageways and is arranged to enable the contents of the two compartments to be ejected, e.g., squeezed, from the package together.

BRIEF DESCRIPTION OF THE DRAWINGS

Other objects and many of the attendant advantages of this invention will be readily appreciated as the same becomes better understood by reference to the following detailed description when considered in connection with the accompanying drawings wherein:

FIG. 2 is a reduced size plan view of one face of the package of FIG. 1;

FIG. 3 is an enlarged sectional view taken along line 3—3 of FIG. 1;

DETAILED DESCRIPTION OF PREFERRED EMBODIMENTS

Figure 1:
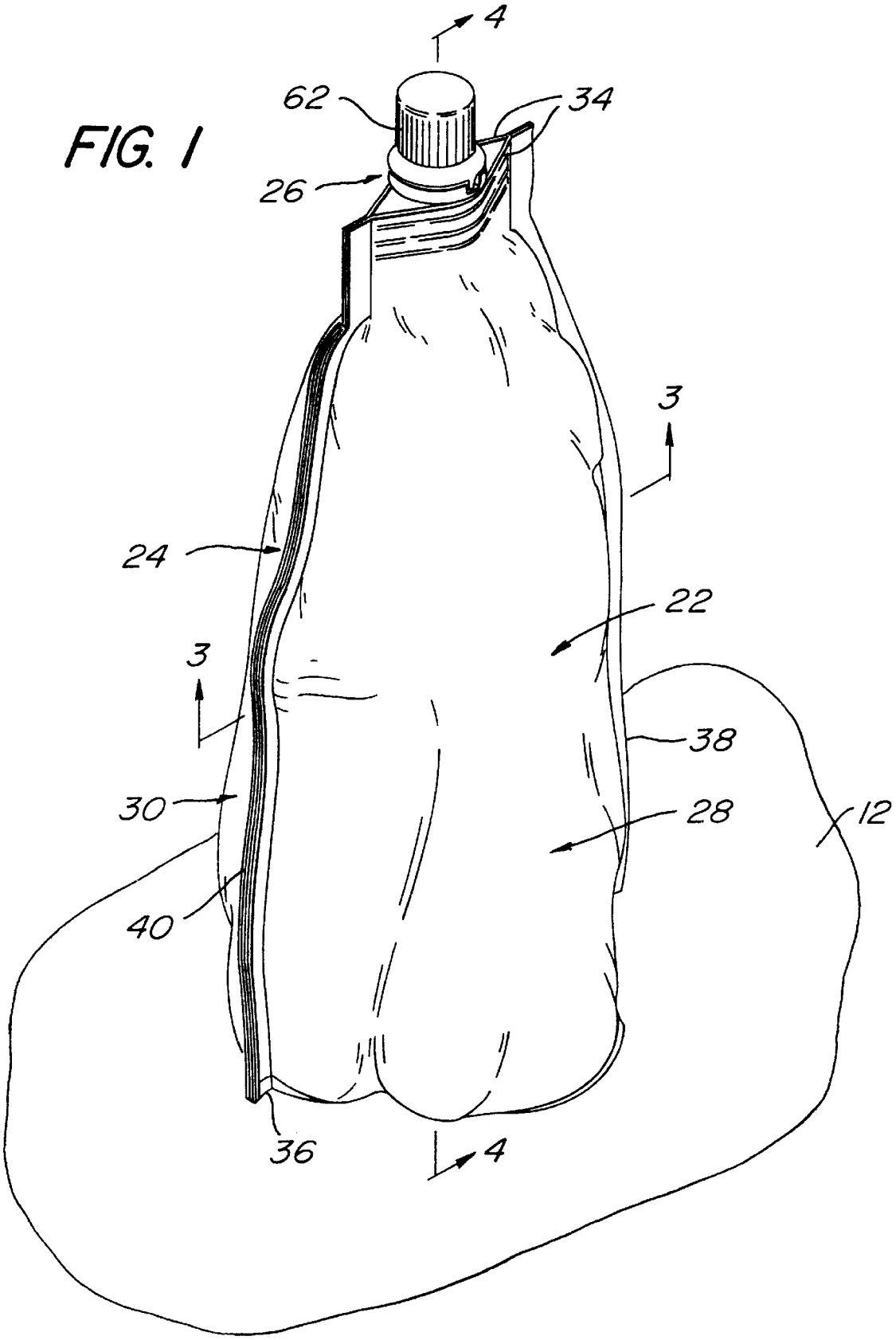
FIG. 1 is an isometric view of a flexible package constructed in accordance with this invention and shown in its filled state.

Referring now in greater detail to the figures, there is shown at 20 in FIG. 1 a package constructed in accordance with the teachings of this invention. The package is formed of a flexible material and is designed to hold two flowable materials or paste-like products 10A and 10B (FIGS. 3 and 4), such as two flavors of cake icing, in respective compartments 22 and 24 (to be described later) of the package to provide easy access to those products, e.g., dispensing, simultaneously through hand manipulation. To that end, the package 20 includes a port fitment 26 (also to be described later) which is coupled to the compartments 22 and 24 to enable the two paste-like products 10A and 10B to be dispensed simultaneously from the package through the fitment by squeezing the package. Thus, the package 20 provides the advantages of keeping the two products 10A and 10B separate from each other in a protected environment, while enabling them to be readily dispensed simultaneously through the fitment for mixing and use.

Before describing the details of the package 20, it should be noted that the package 20 shown and described hereinafter is merely one of many possible configurations for packages constructed in accordance with this invention. Thus, the size, shape or product type(s) held within the package is merely exemplary and not limiting. Moreover, the package 20 can be made of a variety of flexible materials, such as a variety of paper, plastic and/or foil materials, in single or multiple layers, as required by the product to be packaged, and provided that such materials can be thermally bonded, e.g., welded, in the manner well known to the flexible packaging industry.

In the preferred embodiment shown the package is in a shape somewhat like a stand-up pouch and is formed of sheets of plastic material. The package includes a front panel 28, a rear panel 30 and a bottom gusset panel 32. The front and rear panels are each of the same shape and their designation as being "front" or "rear" is arbitrary since either panel could be deemed to be the package's front or rear. Either or both of the panels may include indicia, e.g., printed matter, thereon, if desired.

Figure 5:
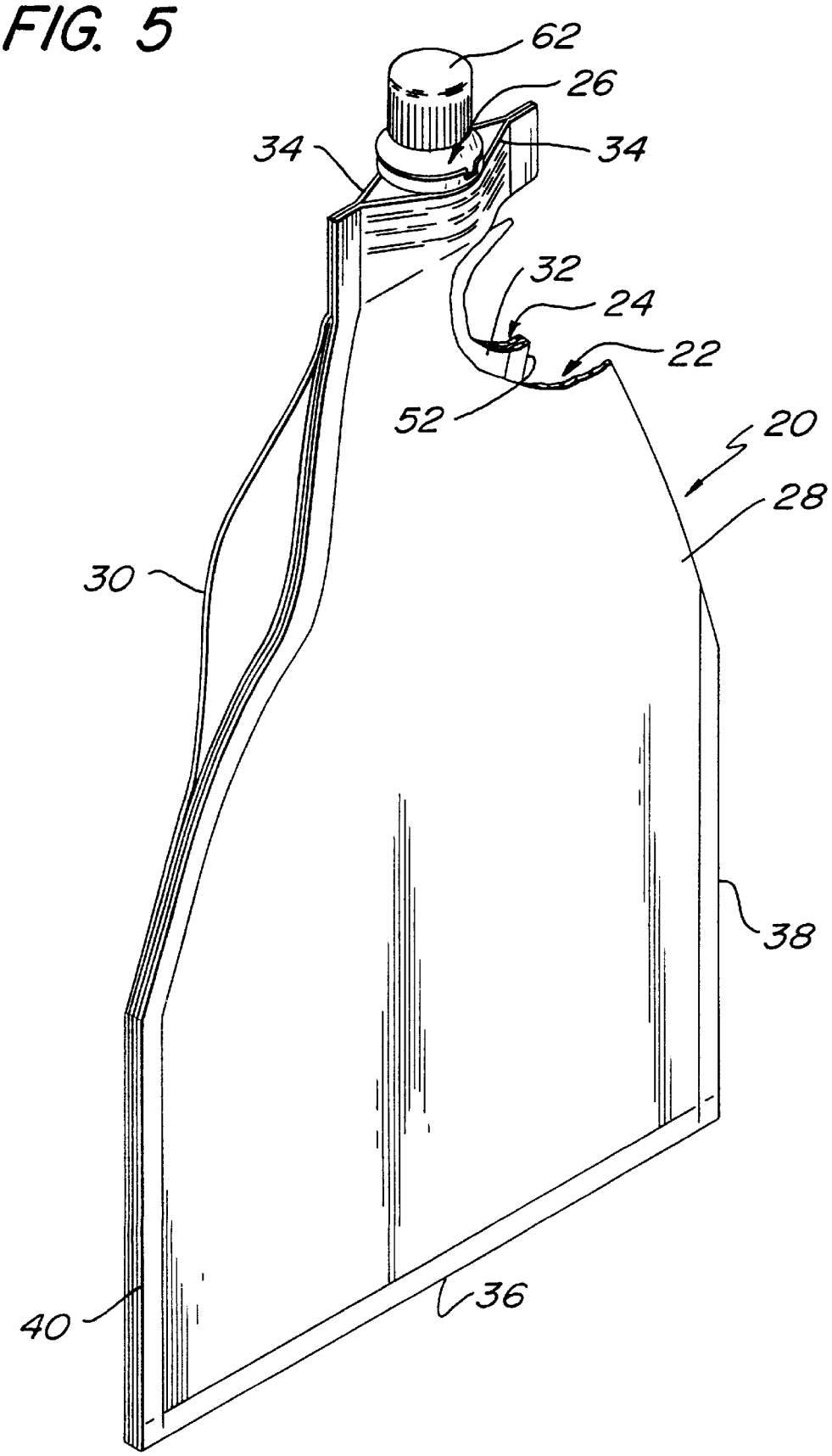
FIG. 5 is an isometric view, partially broken away, showing the flexible package of FIG. 1 prior to being filled.

As best seen in FIGS. 1, 2, and 5 each of the panels 28 and 30 has a generally linear top edge 34, a generally linear bottom edge 36, and a pair of side edges 38 and 40. The lower portions of the side edges 38 and 40 are linear and extend perpendicularly upward from the bottom edge 36. The upper portions of the side edges 38 and 40 as best seen in FIG. 2 are linear but extend inward at an acute angle to the lower portions of the side edges and terminate at the top edge 34.

Figure 4:
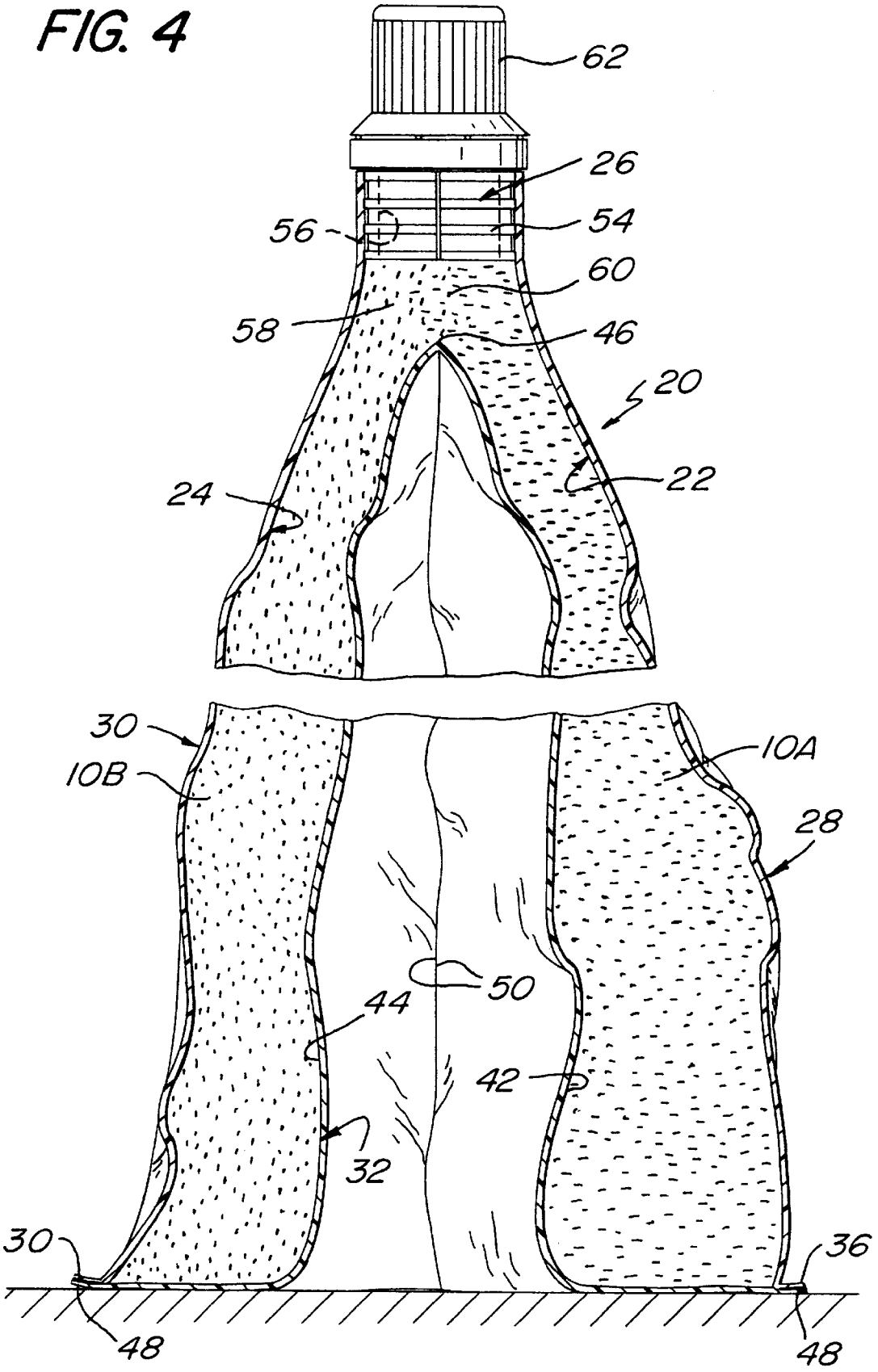
FIG. 4 is an enlarged sectional view taken along line 4—4 of FIG. 1.

The bottom gusset panel 32 (FIGS. 3 and 4), whose shape will be described hereinafter, is secured, e.g., welded, to the bottom edge 36 of the front panel 28 and to the bottom edge 36 of the rear panel 30. The gusset panel 32 includes two sections 42 and 44, each of which is of a similar shape to the front and rear panels 28 and 30. The two sections of the gusset panel 32 are connected at a top fold line 46. The bottom edge of each of the gusset panel sections 42 and 44 is designated by the reference number 48 (FIG. 4). It is these edges which are secured to the bottom edges 36 of the front and rear panels 28 and 30. In particular, the bottom edge 48 of the gusset panel section 42 is welded to the bottom edge 36 of the front panel 28. Similarly, the bottom edge 48 of the gusset panel section 44 is welded to the bottom edge 36 of the rear panel 30.

Each of the gusset panel sections 42 and 44 has a pair of side edges 50 and 52 which are shaped similarly to the side edges 38 and 40 of the front and rear panels 28 and 30, respectively.

In order to form the two compartments 22 and 24 the side edges of the front panel, the rear and the gusset panel are fixedly secured, e.g., welded, together. In particular, the side edge 38 of the front panel 28, the side edge 50 of the gusset panel section 42, the side edge 50 of the gusset panel section 44 and the side edge 38 of the rear panel 30 are all welded together along their entire lengths. In a similar manner, the side edge 40 of the front panel 28, the side edge 52 of the gusset panel section 42, the side edge 52 of the gusset panel section 44 and the side edge 38 of the rear panel 30 are all welded together along their entire lengths. Thus, one compartment 22 is formed between the sealed marginal edges of the front panel 28 and the immediately adjacent gusset panel section 42. The other compartment 24 is formed between the sealed marginal edges of the rear panel 30 and the immediately adjacent gusset panel section 44. Each compartment includes a passageway at its upper end which communicate with each other, as will be described later.

The port fitment 26 is of any conventional construction and basically comprises a canoe-shaped base 54 having a central passageway 56 (FIG. 4) extending vertically therethrough and terminating at an open outlet port (not shown). The canoe-shaped base 54 of the fitment is welded in place between the upper edges 34 of the front and rear panels 28 and 30, respectively, with the portions of those panels extending beyond the fitment being welded to each other to seal the top of the package 20. The lower end of the central passageway 56 is in communication with the interior 58 (FIG. 4) of the package 20 immediately above the fold 46 of the gusset panel 32. The area 58 serves as a merger zone at which the open top portion or passageway of the compartment 22 and the open top portion or passageway of the compartment 24 meet. Thus, the materials 10A and 10B within the compartments 22 and 24 can merge within the zone 58 at an interface 60. A cap 62 is provided on the fitment and is releasably secured, e.g., screwed, to the fitment over its outlet port. The cap 62 thus serves to close off the outlet port to prevent any of the paste-like materials within the package from leaking out of the outlet port.

When it is desired to dispense the materials, all that is necessary is to remove the cap 62 and to squeeze the package's two compartments to cause the products 10A and 10B therein to flow upward into the zone 58 and then out through the outlet port of the fitment 26. Once the desired amount of the two paste-like materials have been dispensed, e.g., extruded, the fitment's cap 62 can be replaced (screwed in place) to seal the remaining products within the two compartments of the package.

As should be appreciated by those skilled in the art, since the bottom edge of the front panel 28 is not secured to the bottom edge of the rear panel 30 (the bottom edge of the font panel is secured to the bottom edge of the gusset section 42, and the bottom edge of the rear panel is secured to the bottom edge of the gusset section 44), the bottom of the package 20 has an "open" configuration. In particular, the bottom portion of the package's compartment 22 can be separated from the bottom portion of the package's compartment 24 (except for the marginal edges at which they are joined), whereupon the package can be arranged to form a "stand pouch." ##In particular, the portions of the bottom of the package which are spread apart from each other can be used to form a wide stable base to support the package 20 in an upright position on any horizontal surface, like a shelf 12 as shown in FIG. 1.

It should be pointed out at this juncture that the package 20 can be constructed so that the two compartments 22 and 24 are physically isolated from each other within the package until their contents are to be dispensed. In such a case the fold line 46 of the gusset panel 32 may be weakly welded to either the front panel 28 or rear panel 30 to create a sealed compartment between the gusset panel and the front or rear panel. The weld, being weakened is adapted to be ruptured by the pressure produced when the package is squeezed to dispense the contents from the sealed chamber, whereupon the weld breaks to enable the contents of the once-sealed compartment to flow to the fitment where it meets with the contents of the other compartment and are dispensed together. In lieu of a rupturable or weakened weld line, the weld line can be permanent and not rupturable, but the gusset panel section adjacent the weld line can be weakened and rupturable, e.g., perforated, so that upon squeezing the weakened line ruptures to enable the contents of the compartment to flow out.

In another contemplated embodiment of this invention the fitment can be configured to extend all the way to the dual compartment area of the package and can include two flow-through ports. One of such ports is in fluid communication with the interior of one compartment and the other port is in fluid communication with the interior of the other compartment. In such an alternative embodiment the two compartments can be physically isolated from each other, and their contents dispensed simultaneously through respective ports of the fitment.

In lieu of using a fitment to serve as the package's outlet or mouth the package 20 may include a cut-off or tear-off dispensing mouth. In particular, in one such an alternative embodiment the top portion of the package includes a weakened line extending transversely thereacross slightly below the top edge 34 and which can be torn to form an open mouth communicating with the zone 58 at the outlet of the two compartments 22 and 24. Alternatively, the package may include indicia or instructions to have the user sever the package along a line extending slightly below the top edge of the package to form an open mouth communicating with the zone 58 at the outlet of the two compartments 22 and 24. Moreover, either of these fitment-less embodiments can make use a gusset panel either weakly welded to the front or rear panel or including a weakened line, as discussed above, to physically isolate the contents of the two chambers from each other until they are to be dispensed.

Without further elaboration the foregoing will so fully illustrate my invention that others may, by applying current or future knowledge, adopt the same for use under various conditions of service.

I claim:

1. A dispensing package formed of a flexible material and comprising first and second separate compartments and an outlet coupled to said compartments, said first compartment having a first outer panel and a first inner panel, said second compartment having a second outer panel and a second inner panel, said first outer panel and said first inner panel each having top portion, a pair of side marginal edges and a bottom edge, said bottom edge of said first outer panel and said first inner panel being secured together, said top portion of said first outer panel and said top portion of said first inner panel defining a first passageway therebetween, said second outer panel and said second inner panel each having a top portion, a pair of side marginal edges and a bottom edge, said bottom edge of said second outer panel and said second inner panel being secured together, said top portion of said second outer panel and said top portion of said second inner panel defining a second passageway therebetween, said side marginal edges of said first outer panel, said first inner panel, said second outer panel, and said second inner panel all being secured together, said first and second compartments being juxtaposed with respect to each other, with said first and second inner panels being disposed confronting each other, said first and second inner panels being arranged to be spaced apart from each other, whereupon said bottom edge of said first compartment and said bottom edge of said second compartment form a wide, stable base for supporting said package in an upright orientation, said outlet being coupled to said passageways and arranged to enable the contents of said compartments to be ejected from the package.

2. The package of claim 1 additionally comprising a fitment located at said outlet and fixedly secured to said outer panels of said first and second compartments, said fitment including a passageway in communication with said passageways.

3. The package of claim 2 wherein said fitment comprises a removable cap.

4. The package of claim 1 wherein said first and second inner panels are formed of a gusset panel having a fold line joining said first and second inner panels.

5. The package of claim 2 wherein said first and second inner panels are formed of a gusset panel having a fold line joining the upper portions of said first and second inner panels.

6. The package of claim 1 wherein each of said compartments tapers toward said outlet.

7. The package of claim 2 wherein each of said compartments tapers toward said outlet.

8. The package of claim 1 wherein said flexible material comprises a material enabling the thermal bonding of said panels to each other.

9. The package of claim 1 wherein said flexible material comprises a plastic material.

* * * * *